US005758744A

United States Patent [19]

Forino

[11] Patent Number: 5,758,744

[45] Date of Patent: Jun. 2, 1998

[54] SAWHORSE

[76] Inventor: Charles Forino, 764 Pine Lake Dr., Westwood, N.J. 07675

[21] Appl. No.: 689,452

[22] Filed: Aug. 9, 1996

[51] Int. Cl.[6] ..... E04G 1/00

[52] U.S. Cl. ..... 182/181.1; 182/186.3; 182/224

[58] Field of Search ..... 182/186, 226, 182/181, 185, 224, 151

[56] References Cited

U.S. PATENT DOCUMENTS

| | | | |
|---|---|---|---|
| 145,174 | 12/1873 | Harden | 182/181 X |
| 400,787 | 11/1889 | Barr . | |
| 947,464 | 1/1910 | Vickers . | |
| 962,976 | 6/1910 | Pence et al. . | |
| 1,226,112 | 5/1917 | Pepin et al. . | |
| 1,442,353 | 1/1923 | Merkel . | |
| 2,197,187 | 4/1940 | Larson . | |
| 3,078,957 | 2/1963 | Larson | 182/226 |
| 3,349,869 | 10/1967 | Evans | 182/226 |
| 4,241,808 | 12/1980 | Middleton et al. | 182/181 X |
| 4,278,148 | 7/1981 | Daley et al. | 182/181 |
| 5,265,697 | 11/1993 | Quick | 182/151 X |
| 5,439,073 | 8/1995 | Johnson | 182/153 |

FOREIGN PATENT DOCUMENTS

| | | | |
|---|---|---|---|
| 873877 | 7/1942 | France | 182/186 |
| 163333 | 8/1933 | Switzerland | 182/181 |

*Primary Examiner*—Alvin C. Chin-Shue
*Assistant Examiner*—Long Dinh Phan
*Attorney, Agent, or Firm*—Friscia & Nussbaum

[57] ABSTRACT

A sawhorse apparatus and a method of constructing a sawhorse is provided. The sawhorse apparatus comprises a horizontal top rail, support legs, lower leg members and a pair of diagonal brace members. The support legs may be notched at upper ends thereof to receive the top rail between opposing support leg members. The legs are firmly secured to the top rail. Opposing legs are interconnected at their lower ends by lower leg members. Diagonal braces extend from the top rail to the lower leg members to further support the top rail. The lower ends of the diagonal braces can be notched to receive the lower leg members. Additionally, the diagonal braces cross over each other, extending from one side of the top rail to the lower leg members at the opposite side of the sawhorse. The method includes appropriately notching the support legs to receive the rail and the diagonal brace members to receive the lower leg support members.

12 Claims, 4 Drawing Sheets

SAWHORSE

BACKGROUND OF THE INVENTION

1. Field of the Invention

This invention generally relates to a sawhorse and more particularly to a sawhorse with notched legs and braces for added strength, sturdiness and stability.

2. Related Art

Carpenters, masons, painters, construction workers and other artisans use sawhorses to support workpieces. Frequently, the size, weight and dimensions of these workpieces will vary according to circumstances. To accommodate these workpieces, it is often desirable to have a sawhorse which is strong enough to support a workpiece regardless of the weight of the workpiece.

Conventional sawhorses have an upper rail that is supported by supporting legs in various ways, including attaching the supporting legs directly to the rail, or by sandwiching the rail between the legs and resting the top rail on a cross member interconnecting the tops of the legs.

Conventional sawhorses are also braced to accommodate the weight of a heavy workpiece in such a way that reduces the "splaying" of their supporting legs. To brace against splaying, a leg support is typically attached between opposing legs. While effective, this bracing does not provide the opposing legs with sufficient strength to support an exceptionally heavy workpiece. As a result of this deficiency, conventional sawhorses tend to buckle or collapse underneath heavy workpieces, perhaps causing injury to workers in the immediate area as well as possibly producing injury and/or property damage to the workpiece.

It is important that a sawhorse be light enough to be conveniently portable, yet strong enough to withstand the weight of a heavy workpiece. As a result, any improvement in the design and construction of a sawhorse which does not substantially increase the overall weight of the horse, yet significantly enhances its strength and sturdiness would be a desirable development.

Examples of previous efforts at sawhorses and other support means include:

Johnson, U.S. Pat. No. 5,439,073 (1995) discloses a foldaway splay legged stand. The upper end portions of the splayed legs are connected by pins which slide along a pair of matching slots that are formed into the interior side of each pair of opposing legs in a lengthwise direction. Sliding the pins into their slots enables the upper ends of the legs to be fitted into sockets in the bridge or crosspiece of the sawhorse and enables the legs to be withdrawn from the crosspiece socket. Once withdrawn, the legs may be swung together so as to be parallel and folded onto the underside of the crosspiece. Once folded, both pairs of legs overlap to make for a stand that is very compact and easily stored.

Quick, U.S. Pat. No. 5,265,697 (1993) discloses a sawhorse having a stepshelf. The legs of this sawhorse are removably attachable to the bridge. The stepshelf is of a rectangular shape and has a cutout portion at each of its four corners that is substantially identical to the cross section of each leg. To assemble the sawhorse, its legs are passed through the cutout portions of the stepshelf and the shelf rests within notches, that are provided. Furthermore, Quick discloses and claims two pairs of vertically directed rabbet grooves carved into the top rail that accommodate the top ends of the legs to sandwich the top rail between the two pairs of legs.

Evans, U.S. Pat. No. 3,349,869 (1967) discloses a sawhorse bracket assembly for holding a crossbeam and a pair of legs. The bracket assembly is comprises of a pair of cooperating metallic jaws which are joined by a hinge and coupled by a bolt. The bracket assembly also carries leg gripping tongues to grip the wooden support legs that are inserted into sockets formed in the bracket.

Larson, U.S. Pat. No. 3,078,957 (1963) discloses a collapsible sawhorse bracket assembly. A pair of brackets and a strap is provided on each side of each leg. Each bracket has an L-shaped strap that includes a flange that is adapted to be secured to the underside of the crosspiece, and a perpendicular second flange that extends in a direction normal to the longitudinal axis of the crosspiece. The strap is connected to the bracket by means of a lock pin which extends through the L-shaped slots in the brackets and the elongated slot in the straps.

Larson, U.S. Pat. No. 2,197,187 (1940) discloses an arrangement of duplicate metal plates, each provided with converging flanges and a notch, to form rigid joints for sawhorses. The upwardly converging wooden legs of the sawhorse are engaged by the metal flanges and the side edges of the notches are formed to cut into the sides of the wooden beam.

Merkel, U.S. Pat. No. 1,442,353 (1923) discloses a sawhorse comprising a bridge sawhorse recessed at opposite points adjacent to each end to receive interfitting recessed legs. These recesses are cut to a greater depth at the bottom of the bridge of the sawhorse. Such a shaped recess provides the legs with a maximum supporting shoulder for a given spread of the legs. Furthermore, each leg is recessed so as to create a thick top portion at the forward side of the leg and a thinner portion at the rear side of the leg.

Pepin, U.S. Pat. No. 1,226,112 (1917) discloses a folding sawhorse having a bridge whose side faces are laterally inclined to correspond with the incline of the legs. The upper portion of each leg is adjustably attached to the bridge by means of a bolt. Additional bolts are located within the interior of the bridge to fasten or release a separate pivotable diagonal members which slide within a slot in the lower portion of each leg.

Pence, et al, U.S. Pat. No. 962,976 (1910) discloses a sawhorse which may be extended to varying heights, regardless of the load applied, and may be collapsed into a compact space when not in use. The horse comprises two pairs of folding legs and an extension member.

Vickers, U.S. Pat. No. 947,464 (1910) discloses a collapsible sawhorse structure. The members comprising the sawhorse are connected via hinges. These members are also socketed to contain other folded members when the sawhorse is collapsed.

Barr, British Patent No. 400,787 (1933) discloses a sawhorse having a vertically adjustable cross bar so that the height of the platform may be varied as desired.

None of these previous efforts disclose all of the benefits of the present invention, nor do these previous patents teach or suggest all of the elements of the present invention.

OBJECTS AND SUMMARY OF THE INVENTION

It is a primary object of the present invention to provide a sawhorse apparatus for supporting a workpiece.

It is also an object of the present invention to provide a sawhorse that is exceptionally strong.

It is another object of the present invention to provide a sawhorse that is relatively light weight.

It is another object of the present invention to provide a sawhorse that is portable.

It is another object of the present invention to provide a sawhorse that is easy to use.

It is even another object of the present invention to provide a sawhorse that is easy to manufacture.

It is yet another object of the present invention to provide a sawhorse with opposing support legs having notches for connection with an upper rail of the sawhorse.

It is another object of the present invention to provide a sawhorse apparatus having lower leg members connected between opposing support legs.

It is still yet another object of the invention to provide a sawhorse having diagonal brace members extending between the upper rail and lower leg members connected between opposing support legs.

It is still another object of the present invention to provide a sawhorse that exhibits great strength yet can be constructed from conventional materials.

It is even another object of the present invention to provide a sawhorse apparatus that has a structural integrity which is superior to the structural integrity of a conventional sawhorse.

It is another object of the present invention to provide a sawhorse apparatus having a pair of bracing members which extend diagonally across the body of the sawhorse.

It is another object of the present invention to provide a sawhorse having a pair of bracing members which crossover from one side of a top rail to opposite legs.

It is even an additional object of the present invention to provide diagonal brace members having notched lower ends for interconnecting with lower leg members.

These and other objects are achieved by the sawhorse of the present invention which includes a horizontal top rail and support legs. The support legs are notched at upper ends thereof to receive the top rail between opposing leg members. Opposing support legs are interconnected at their lower ends by lower leg members. Diagonal braces extend from the top rail to the lower leg members to further support the top rail. The lower ends of the diagonal braces can be notched to mate the lower leg members. Additionally, the diagonal braces preferably extend from one portion of the top rail to the opposite lower leg member to support and brace the top rail.

BRIEF DESCRIPTION OF THE DRAWINGS

Other important objects and features of the invention will be apparent from the following Detailed Description of the Invention when read in context with the accompanying drawings in which.

DETAILED DESCRIPTION OF THE INVENTION

Figure 1:
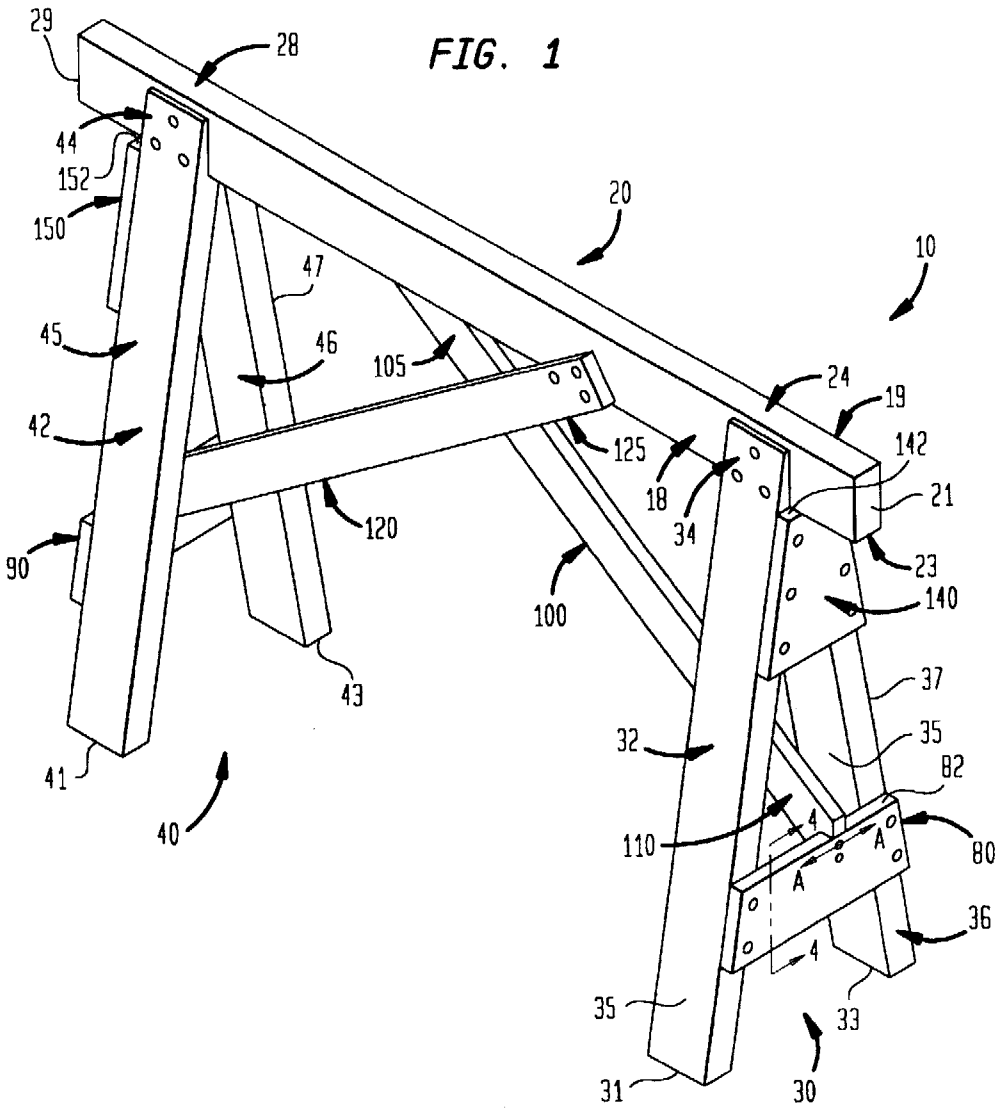
FIG. 1 is a perspective view of the sawhorse apparatus of the present invention.
Figure 2:
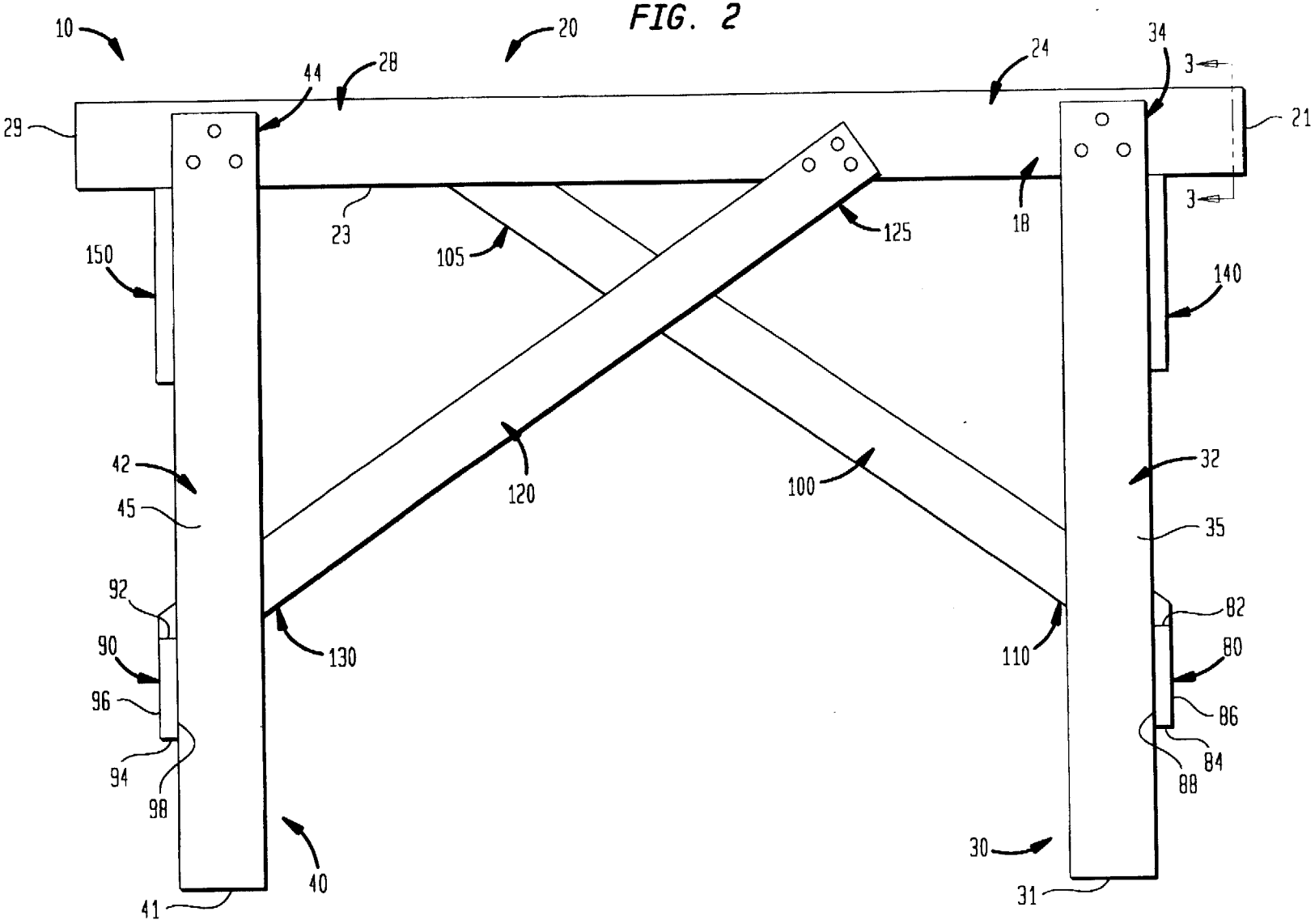
FIG. 2 is a side plan view of the sawhorse apparatus shown in FIG. 1.

The present invention relates to a sawhorse apparatus for supporting a workpiece, and a method of constructing a sawhorse. As shown in FIGS. 1 and 2, the sawhorse, generally indicated at 10, comprises a horizontal top rail 20 and two pairs of supporting legs 30 and 40.

The top rail 20 comprises a member having a first portion 24 and a second portion 28. The top rail 20 includes an underside 23, side surfaces 18 and 19, and ends 21 and 29.

Each pair of supporting legs comprises leg members positioned in opposing relation. The first pair 30 of supporting legs includes legs 32 and 36 having top ends 34 and 38, respectively, which are attached to the first portion 24 of the horizontal top rail 20. Legs 32 and 36 also include bottom ends 31 and 33 for contacting the ground and supporting the sawhorse 10. Also, leg members 32 and 36 each have side surfaces 35 and 37. The second pair of supporting legs 40 comprises leg members 42 and 46 having top ends 44 and 48, respectively, which are attached to the second portion 28 of the horizontal top rail 20. Legs 42 and 46 also include bottom ends 41 and 43 for contacting the ground and supporting the sawhorse 10. Also, leg members 42 and 46 each have side surfaces 45 and 47.

Figure 3:
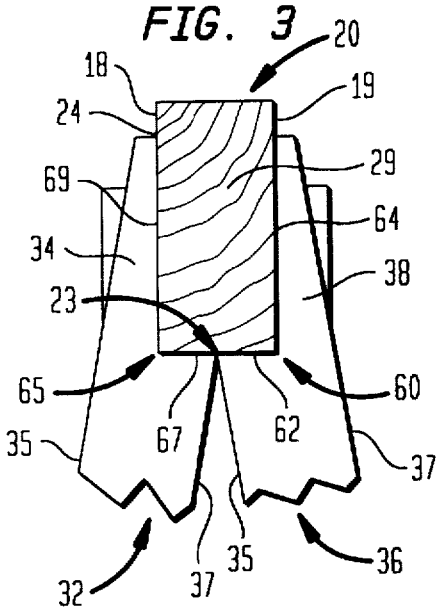
FIG. 3 is a partially cut-away, cross-sectional view of the sawhorse apparatus shown in FIG. 2 taken along line 3—3.

As shown in FIG. 3, to make for a strong attachment, each of the leg members 32 and 36, are cut, grooved, recessed, notched or otherwise geometrically modified at their top ends 34 and 38 to mate with the physical dimensions of the horizontal top rail 20. As so modified, the leg members 32 and 36 include notches 60 and 65 having bases 62 and 67 for receiving and contacting the underside 23 of the top rail 20, and a vertical walls 64 and 69 for contacting the sides 18 and 19 of the top rail 20. The second pair of leg members 42 and 46 are attached to the second portion 28 of the horizontal top rail 20 in the same manner.

The leg members 32 and 36, and 42 and 46, may be fastened to the horizontal top rail 20 by a plurality of nails or screws or other fastening means known in the art.

Referring back to FIGS. 1 and 2, a lower leg support members 80 and 90 are attached between leg members 32 and 36, and 42 and 46, respectively. The lower leg support members 80 and 90 include upper surfaces, 82 and 92, lower surfaces 84 and 94, and front and back surfaces 86, 88 and 96, 98, respectively. The lower leg members 80 and 90 brace the opposing leg members 32 and 36, and 42 and 46, to prevent the pairs of supporting legs 30 and 40 from splaying when a workpiece is placed upon the horizontal top rail 20 of the sawhorse 10.

Figure 4:
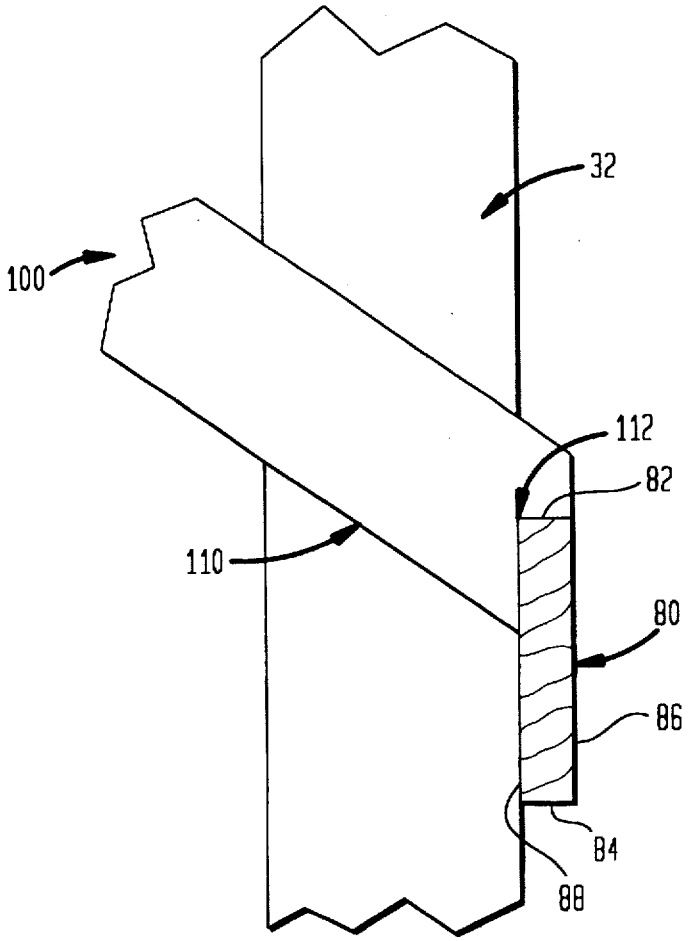
FIG. 4 is a partially cut away, cross-sectional view of the sawhorse apparatus shown in FIG. 1 taken along line 4—4.

Still referring to FIGS. 1 and 2, and also referring to FIG. 4, first and second diagonal brace members 100 and 120 are attached between the horizontal top rail 20 and the lower leg members 80 and 90. The upper end 105 of the first diagonal brace member 100 attaches to the top rail 20, and the lower end 110 of the first diagonal brace member 100 attaches to the lower leg support member 80. The lower end 110 of the diagonal brace 100 may terminate in a notch 112 or may be otherwise geometrically modified to receive and mate with surfaces 82 and 88 of the lower leg support member 80.

Likewise, the upper end 125 of the second diagonal brace member 120 attaches to the top rail 20, and the lower end 130 of the second diagonal brace member 120 attaches to the lower leg support member 90. The lower end 130 of the diagonal brace 120 may terminate in a notch 132 or may be otherwise geometrically modified to receive and mate with surfaces 92 and 98 of the lower leg support member 90.

As shown in FIG. 2, both the first diagonal brace member 100 and the second diagonal brace member 120 form a configuration which appears as an "X" when the sawhorse 10 is viewed from a side. Further, while FIGS. 1 and 2 show that it is preferable to attach the first diagonal brace members 100 and the second diagonal brace member 120 to the top rail 20 at locations which are approximately one-third of the total length of the top rail 20 as measured from the opposing end of the top rail 20 such an arrangement is by no means limiting. Rather, the brace members 100 and 120 could be interconnected with the top rail 20 at any desired position, even such that the brace members 100 and 120 do not cross over each other.

The ends of the diagonal brace members 100 and 120 can be attached to the lower leg support members 80 and 90, and the top rail 20 by a plurality of nails or screws or other fastening means known in the art. It should be pointed out that the lower end 110 of the diagonal brace members 100 could be detached from the lower leg member 80 and could be moved in the direction of arrows A in FIG. 1, and then be re-attached at another location to skew the sawhorse 10 to permit the sawhorse 10 to accommodate uneven ground yet evenly support a workpiece. Also, it should be pointed out that removable fastening means could be employed to facilitate movement of the lower end 110 of brace member 100 with respect to the lower leg member 80. Additionally, it should also be pointed out that the other brace member 120 could likewise be adjusted.

Once again referring to FIGS. 1 and FIG. 2, to further reinforce the sawhorse 10 of the present invention, first and second upper leg support members 140 and 150 may be interconnected to the leg members 32 and 36 and 42 and 46. The upper surfaces 142 and 152 of the upper leg support members 140 and 150, respectively, may be brought into physical contact with the underside 23 of the top rail 20 to provide additional support thereto.

Figure 5:
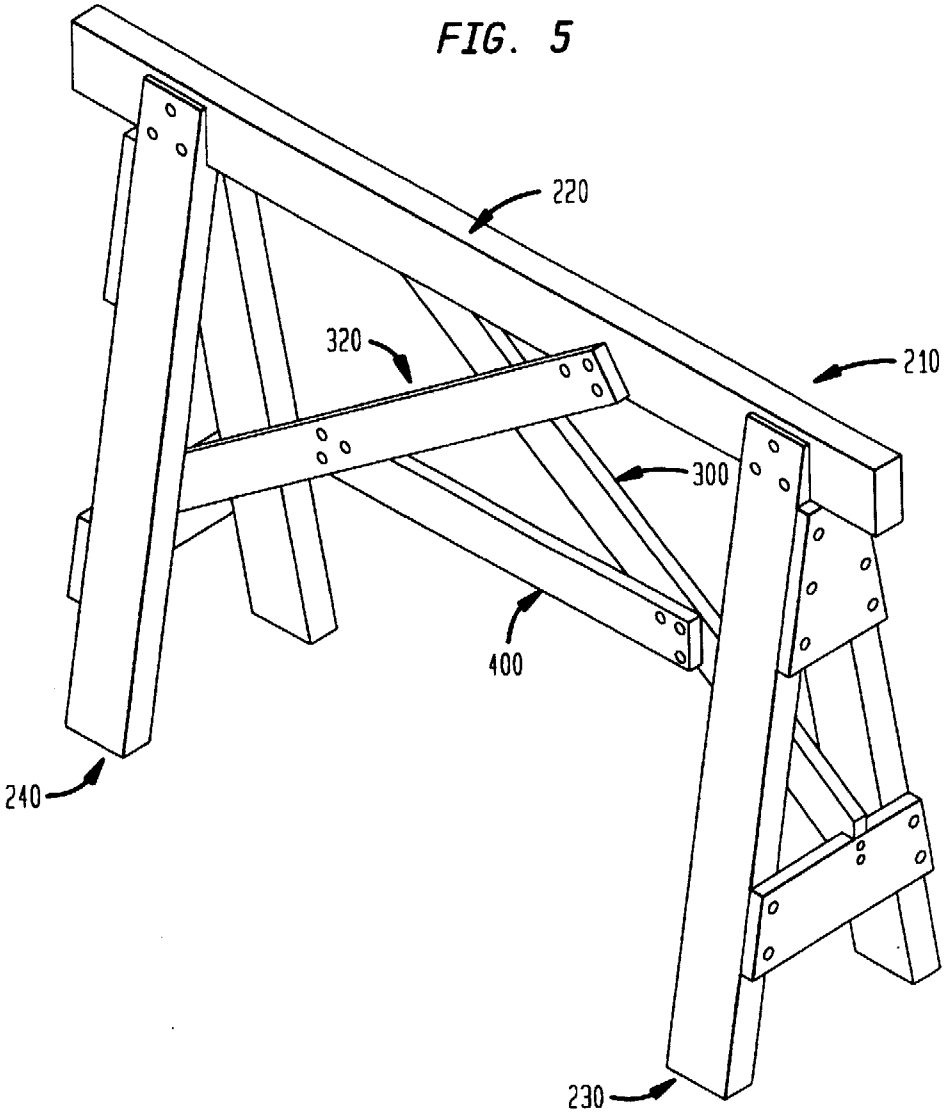
FIG. 5 is a perspective view of another embodiment of the sawhorse apparatus of the present invention.

As shown in FIG. 5, in another embodiment of the present invention, generally indicated at 210, the sawhorse comprises top rail 220, legs supports 230 and 240 and diagonal cross braces 300 and 320. Horizontal brace member 400 is attachable between brace members 300 and 320 to further brace and support the sawhorse 210. Importantly, this horizontal brace member 400 can of a similar width as the top rail 220 to fit between the braces 300 and 320. This brace member 400 can be interconnected with the braces 300 and 320 by screws, nails or any other means known in the art. Also, it should be pointed that brace member 400 could alternatively or also be interconnected directly between support legs 230 and 240.

Also, it should be pointed out that the sawhorse of the present invention could be constructed to be various sizes as desired, either smaller or larger than a conventional sawhorse. Likewise, smaller and lighter, or larger and heavier members can be used to construct the sawhorse. Importantly, by following the teachings of the present invention, a stronger sawhorse can be constructed. Also, any material known in the art could be used to construct the sawhorse.

The method of constructing the sawhorse of the present invention comprises the steps of providing a top rail 20; providing members 32, 36, 42 and 46, each having equal length; notching the upper ends of the leg members 32, 36, 42 and 44; attaching two leg members 32 and 36 to a first portion 24 of the top rail 20 to form a first pair of supporting legs 30; attaching two leg members 42 and 46 to a second portion 28 of the top rail 20 to form a second pair of supporting legs 40; attaching a first lower leg support member 80 between the leg members 32 and 36 to brace the lower half of the first pair of supporting legs 30; and attaching a second lower leg support member 90 between the leg members 42 and 46 to brace the lower half of the second pair of supporting legs 40. Once these leg members 32, 34, 42 and 46 and lower leg supports 80 and 90 are interconnected, the method of constructing the sawhorse of the present invention further comprises the steps of providing two diagonal brace members 100 and 120 of equal length; notching each of the diagonal brace members 100 and 120 at their lower ends 110 and 130; attaching the first diagonal brace 100 member between the first portion 24 of the top rail 20 and the second lower leg support member 90; and attaching a second diagonal brace member 120 between the second portion 28 of the top rail 20 and the first lower leg support member 80.

Additional steps to this method may comprise fabricating a means to adjustably secure each of the diagonal brace members 100 and 120 to the lower leg support members 80 and 90. Further steps may also include attaching upper leg support member 140 to the leg members 32 and 36 as well as attaching upper leg support member 150 to leg members 42 and 46.

Having thus described the invention in detail, it is to be understood that the forgoing description is not intended to limit the spirit and scope thereof. What is desired to be protected by Letters Patent is set forth in the appended claims.

What is claimed is:

1. A strong, rigid, reinforced, sawhorse comprising:

a top rail having first and second portions;

a first pair of opposing legs, each of which are notched at the upper ends to form shoulders to contact and support the first portion of the top rail, the upper ends of the first pair of opposing legs attached to the top rail;

a second pair of opposing legs, each of which are notched at the upper ends to form shoulders to contact and support the second portion of the top rail, the upper ends of the second pair of opposing legs attached to the top rail;

a first lower leg support member attached between lower portions of the first pair of opposing legs;

a second lower leg support member attached between portions of the second pair of opposing legs;

a first diagonal brace member providing vertical support to the top rail, the brace member fixedly attached at an upper end to the first portion at a location approximately one-third of the total length from the first end of the top rail and at a lower end to the second lower leg support member;

a second diagonal brace member providing vertical support to the top rail, the brace member fixedly attached at an upper end to the second portion at a location approximately one-third of the total length from the second end of the top rail and at a lower end to the first lower leg support member; and the first and second diagonal members crossing over each other to form an "X" configuration when the sawhorse is viewed from a lateral side.

2. The sawhorse of claim 1, wherein the brace members are notched at lower ends to form shoulders on the brace members to contact the lower leg support members.

3. The sawhorse of claim 2, further comprising upper leg support members bracing upper portions of each pair of opposing legs.

4. The sawhorse of claim 3, wherein an upper surface of the upper leg support member contacts the top rail.

5. The sawhorse of claim 2, further comprising means for adjustably securing the lower end of the first diagonal brace member along the second lower leg support member.

6. The sawhorse of claim 5, further comprising a peg and hole assembly to adjustably secure the diagonal brace across the lower leg support.

7. A strong, rigid, reinforced, sawhorse comprising:

a top rail having first and second halves;

a first pair of opposing legs, each of which are notched at the upper ends to form shoulders to contact and support the first half of the top rail, the first pair of opposing legs attached to the top rail;

a second pair of opposing legs, each of which are notched at the upper ends to form shoulders to contact and support the second half of the top rail, the second pair of opposing legs attached to the top rail;

a first lower leg support member bracing of the first pair of opposing legs;

a second lower leg support member bracing of the second pair of opposing legs;

a first diagonal brace member providing vertical support to the top rail, the brace member fixedly attached at an upper end to the first half at a location approximately one-third of the total length from the first end of the top rail and at a lower end to the second lower leg support member;

a second diagonal brace member providing vertical support to the top rail, the brace member fixedly attached at an upper end to the second half at a location approximately one-third of the total length from the second end of the top rail and at a lower end to the first lower leg support member;

the first and second diagonal members crossing over each other to form an "X" configuration when the sawhorse is viewed from a lateral side; and notches at the lower ends of each of the diagonal support members to form shoulders to contact the lower leg support members.

8. The sawhorse of claim 7, wherein the lower ends of the diagonal support means can be fixedly attached to the lower leg support members at one of a plurality of points along the lower leg support members to adjust the sawhorse.

9. A method of constructing a strong, rigid, reinforced sawhorse apparatus comprising the steps of:

providing a top rail having an upper surface and a lower surface;

providing for legs for supporting the top rail;

notching upper ends of the legs to form shoulders on the upper legs for contacting the lower surface of the top rail;

attaching two legs to a first half of the top rail to form a first pair of supporting legs, the shoulders contacting and supporting the top rail;

attaching two legs to a second half of the top rail to form a second pair of supporting legs, the shoulders contacting and supporting the top rail;

attaching a first lower leg support member between the first pair of supporting legs;

attaching a second lower leg support member between the second pair of supporting legs;

providing two diagonal brace members for providing vertical support to the top rail;

notching each of the diagonal brace members at lower ends thereof to form shoulders for contacting upper surfaces of the lower leg support members;

attaching an upper end of a first diagonal brace member to a location approximately one-third of the total length from the first end of the top rail and attaching a lower end to the second lower leg support member, the shoulder contacting the upper surface of the lower leg support member;

attaching an upper end of a second diagonal brace member to a location approximately one-third of the total length from the second end of the top rail and attaching a lower end to the first lower leg support member, the shoulder contacting the upper surface of the lower leg support member; and forming an "x" configuration of the brace members when viewed from a side of the sawhorse apparatus.

10. The method of claim 9 further comprising, the step of adjusting the sawhorse by detaching the lower ends of the diagonal brace members from the lower leg support members, re-positioning the lower ends of the diagonal brace members along the lower leg support members, and re-attaching the lower ends of the diagonal brace members to the lower leg support members.

11. The method of claim 9, further comprising the step of attaching a first upper leg support member to brace the upper half of the first pair of supporting legs.

12. The method of claim 11, further comprising the step of attaching a second upper leg support member to brace the upper half of the second pair of supporting legs.

* * * * *